US007677748B2

(12) United States Patent
Hou et al.

(10) Patent No.: US 7,677,748 B2
(45) Date of Patent: Mar. 16, 2010

(54) LIGHT GUIDE DEVICE FOR WATER SPRAYING DEVICE

(76) Inventors: Tsung-Chih Hou, No. 293, Sianeili 15, 11th Neighborhood Neiding Village, Jhongli City, Taoyuan County 320 (TW); Liang-Tsai Chen, No. 22, 67 St., Alley 277, Lane 248, Jhongshan Rd., 9th Neighborhood Xing ren Village, Bade City, Taoyuan County 334 (TW); Liang-Wen Chen, No. 22, 67 St., Alley 277, Lane 248, Jhongshan Rd., 9th Neighborhood Xing ren Village, Bade City, Taoyuan County 334 (TW)

( * ) Notice: Subject to any disclaimer, the term of this patent is extended or adjusted under 35 U.S.C. 154(b) by 255 days.

(21) Appl. No.: 12/003,281

(22) Filed: Dec. 21, 2007

(65) Prior Publication Data

US 2009/0161342 A1 Jun. 25, 2009

(51) Int. Cl.
*F21V 33/00* (2006.01)
*F21V 7/04* (2006.01)

(52) U.S. Cl. ..... 362/96; 362/602; 362/612

(58) Field of Classification Search ..... 362/602, 362/612, 613, 605, 615, 628, 96, 800; 385/901; 239/17–20; 73/36

See application file for complete search history.

(56) References Cited

U.S. PATENT DOCUMENTS

2005/0148066 A1* 7/2005 O'Keefe et al. ..... 435/287.2
2008/0108112 A1* 5/2008 O'keefe et al. ..... 435/91.2
2008/0164336 A1* 7/2008 Kunkel ..... 239/18
2008/0298082 A1* 12/2008 Churchwell ..... 362/602

* cited by examiner

*Primary Examiner*—Bao Q Truong
(74) *Attorney, Agent, or Firm*—Rosenberg, Klein & Lee

(57) ABSTRACT

Disclosed is a light guide device for a water spraying device. The light guide device includes a light guide block that is a light-transmitting block having a refractive index greater than one. The light guide block has a circumferential face in which a plurality of mounting holes is defined for receiving and retaining light-emitting elements. A plurality of through holes is defined through the light guide blocks and extends in a direction substantially perpendicular to the mounting holes. Each through hole has a roughened inside surface. The through holes are in fluid communication with water discharge holes of the water spraying device so that water jets supplied from the water spraying device can flow through the through holes for discharging. The light-emitting elements emit light rays that transmit through the light guide block and get into the through holes and the water jets. The rays are subject to reflection inside the water jets to provide lighting or luminous effect to the water jets.

5 Claims, 10 Drawing Sheets

LIGHT GUIDE DEVICE FOR WATER SPRAYING DEVICE

BACKGROUND OF THE INVENTION

1. Field of the Invention

The present invention relates to a light guide device for a water spraying device, and in particular to a light guide for a water spraying device for decoration and/or cleaning purposes, which light guide provides lighting or luminous effect to water jets sprayed out of the water spraying device.

2. The Related Arts

Water spraying devices for cleaning and decoration purposes are known, such as a fountain that is commonly seen in a garden or a landscaping scene, a water sprinkler or a water sprayer or a shower head for cleaning a human body. The conventional water spraying devices provides only the function of water spraying or water jetting and if decoration of color lights is needed, an external light source must be additionally provided to project light toward or coherent with the water spray or water jets. The certainly makes the water spraying device complicated in structure and installation and thus offers no practical advantages for industrial or commercial applications. Further, it is often that the light added to the water sprays or water jets by an external light source is limited to only a portion of the water sprays or water jets and it is generally not possible to readily cover the water sprays with decoration light from an external light source. Consequently the luminous effect of the water sprays is not consistent to all portions of the water sprays.

Prior art references for adding luminous effect or light to water jet or water spray are known, such as Taiwan Utility Model Publication No. M288806, which discloses a showering device with lighting structure, and No. M276623, which discloses a shower head set. Both references teach to add or mount light-emitting diodes to or external of a sprayer or a sprayer nozzle to project a light beam to a water jet or water spray. These known devices discussed in these references still surfer the same problem or non-consistent luminous effect on the water jet or water spray.

Thus, it is desired to have a water spraying device that generates consistent or uniform lighting on the water spray thereof to overcome the problems discussed above for the conventional devices.

SUMMARY OF THE INVENTION

An objective of the present invention is to provide a light guide device for a water spraying device, wherein the light guide device is composed of modularized light guide block and light emitting elements to provide luminous effect on water sprays sending out from the water spraying device and allows ready application, in a modularized manner, on various devices, such as shower head.

Another objective of the present invention is to provide a light guide device for a water spraying device, which comprises a light guide block made of a material having a refractive index greater than one for uniformly guiding light rays through water sprays from the water spraying device to induce consistent luminous effect and making lighting of the water sprays more consistent and brighter.

To achieve the above discussed objectives, in accordance with the present invention, a light guide device is provided for a water spraying device. The light guide device comprises a light guide block that is a light-transmitting block having a refractive index greater than one. The light guide block has a circumferential face in which a plurality of mounting holes is defined for receiving and retaining light-emitting elements. A plurality of through holes is defined through the light guide blocks and extends in a direction substantially perpendicular to the mounting holes. Each through hole has a roughened inside surface. The through holes are in fluid communication with water discharge holes of the water spraying device so that water jets supplied from the water spraying device can flow through the through holes for discharging. The light-emitting elements emit light rays that transmit through the light guide block and get into the through holes and the water jets. The rays are subject to reflection inside the water jets to provide lighting or luminous effect to the water jets.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
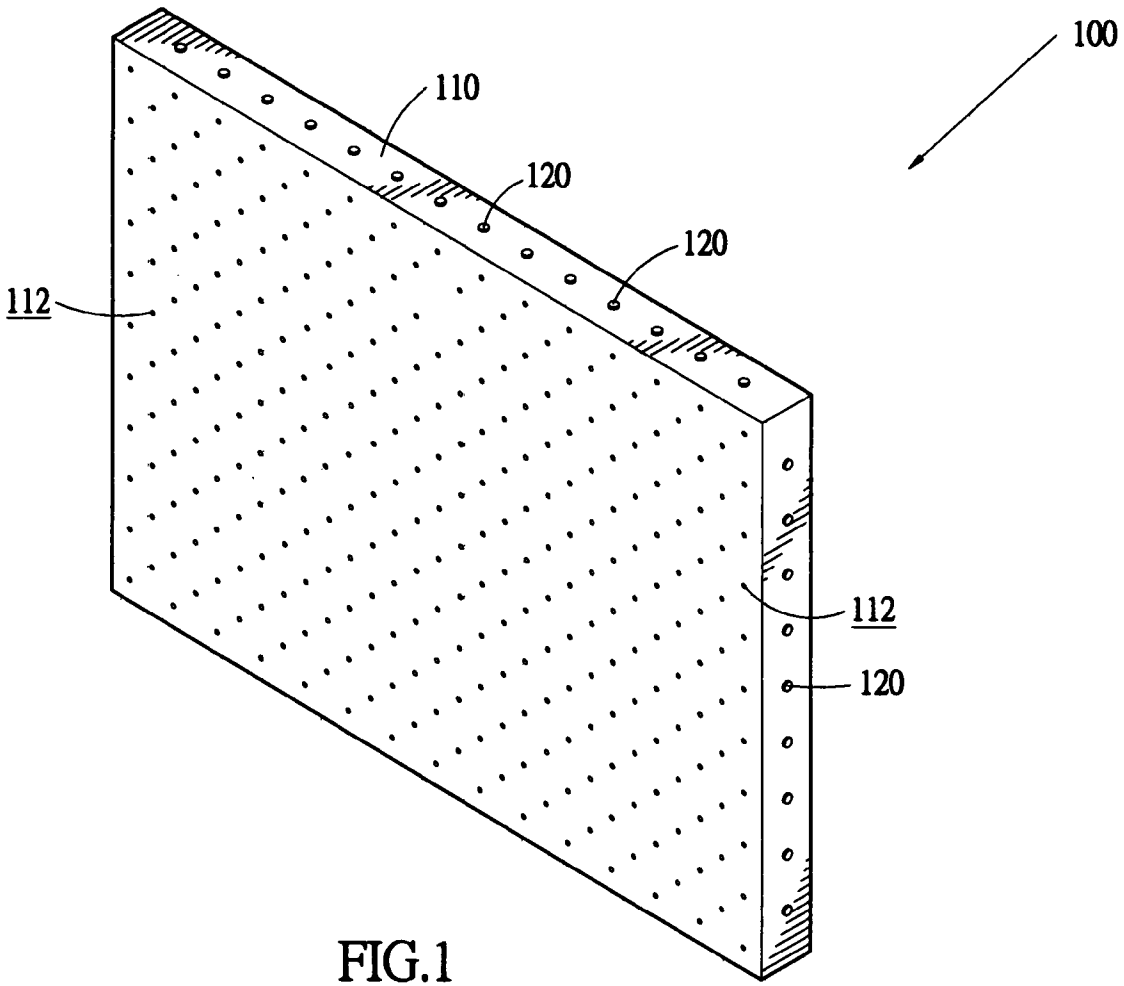
FIG. 1 is a perspective view of a light guide device constructed in accordance with a first embodiment of the present invention.
Figure 2:
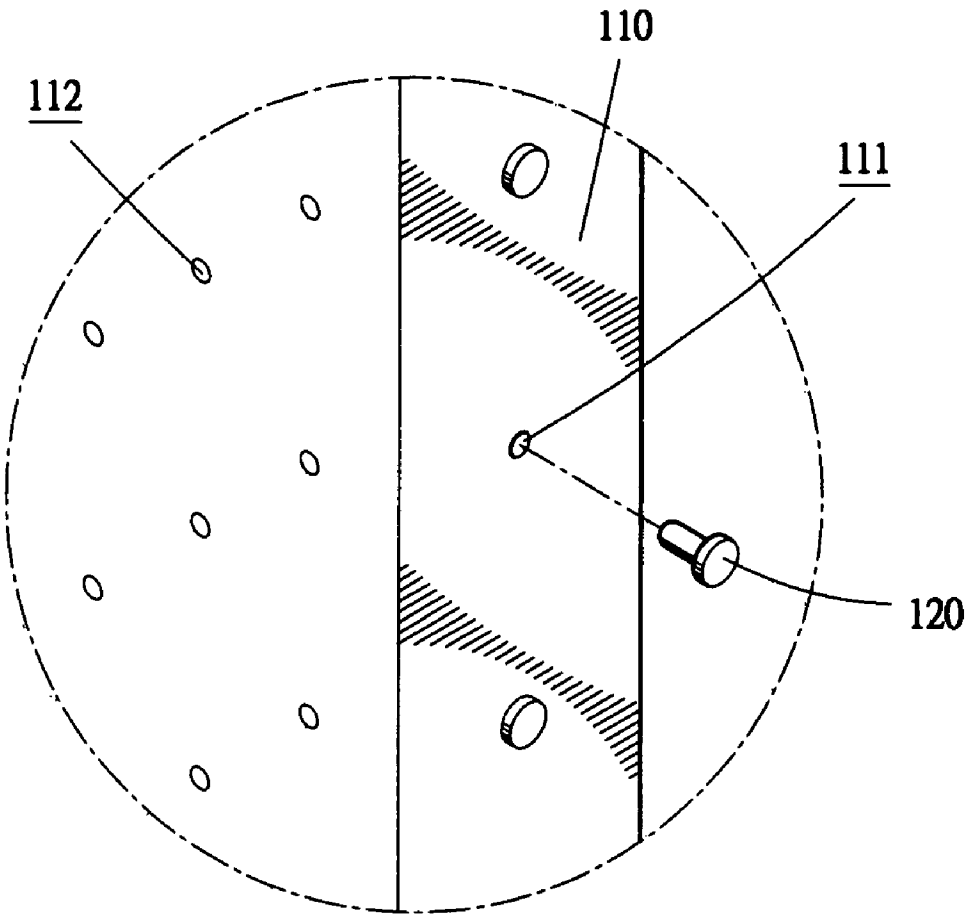
FIG. 2 is an enlarged view of a portion of the light guide device, showing light-emitting elements mounted to mounting holes defined in edges of a light guide block of the light guide device.
Figure 3:
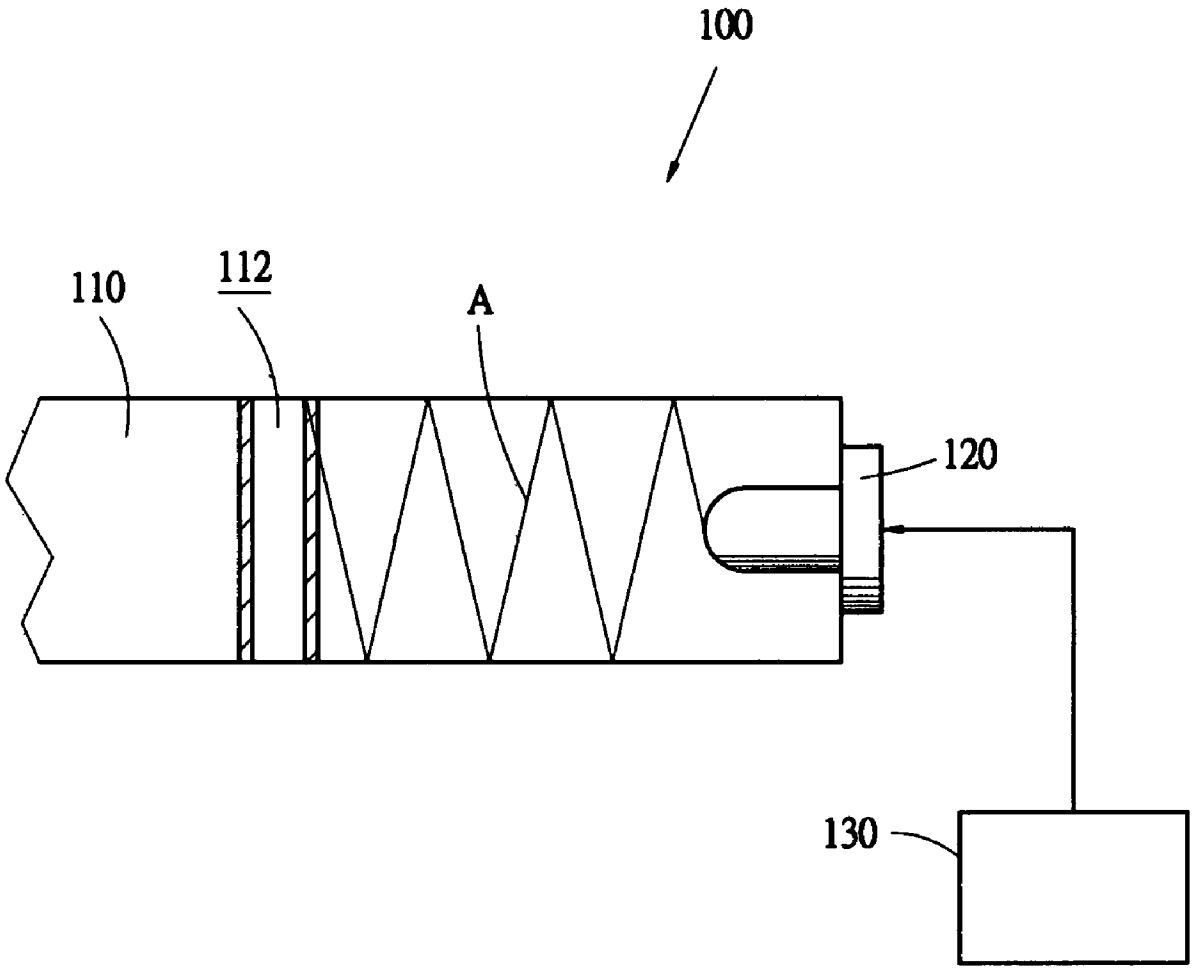
FIG. 3 is a schematic view illustrating light ray emitting from a light-emitting element mounted to a light guide block transmitting through the light guide block and entering a through hole defined in the block.
Figure 4:
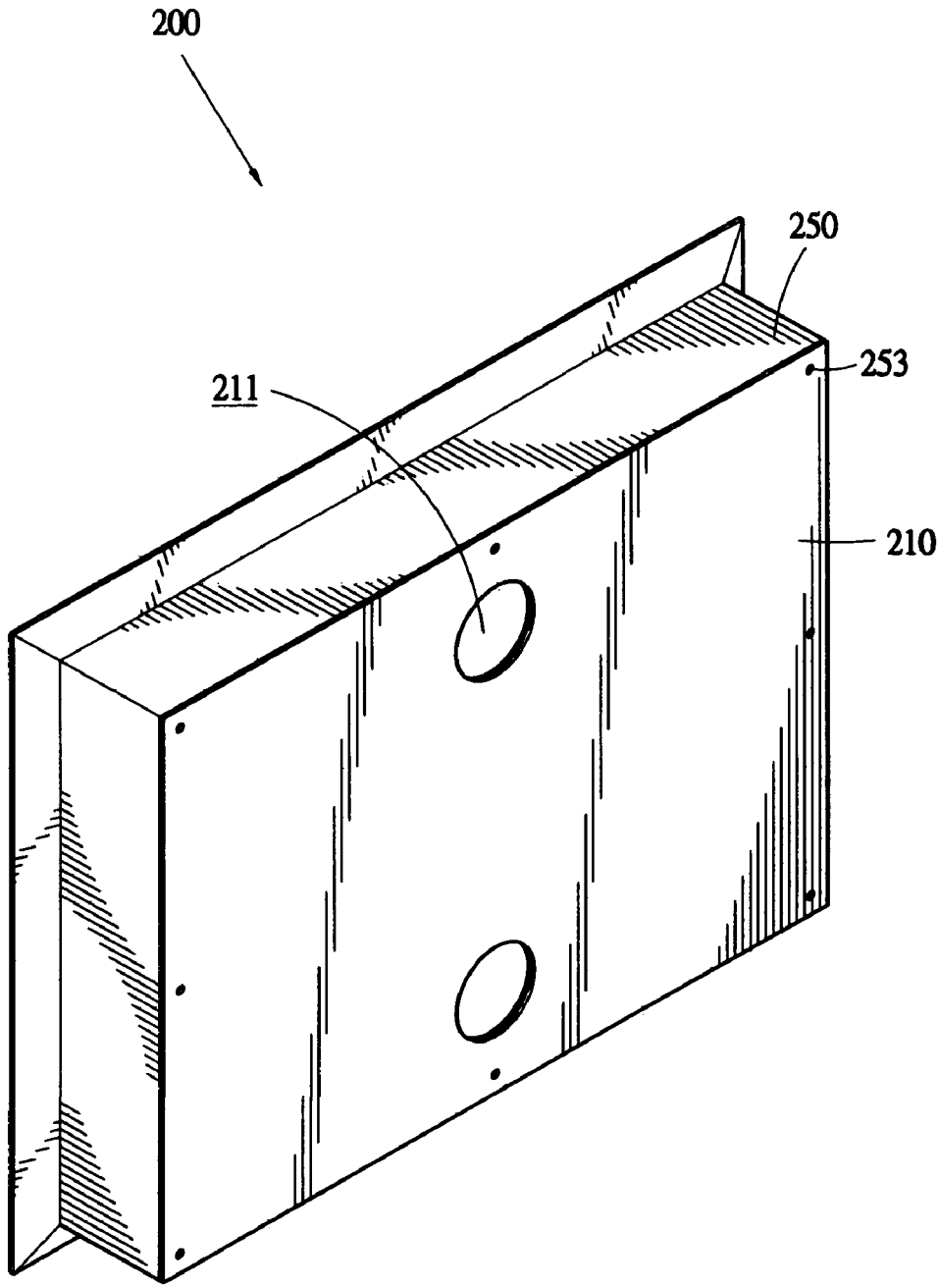
FIG. 4 is a perspective view showing a water spraying device in which the light guide device of the first embodiment of the present invention is incorporated.
Figure 5:
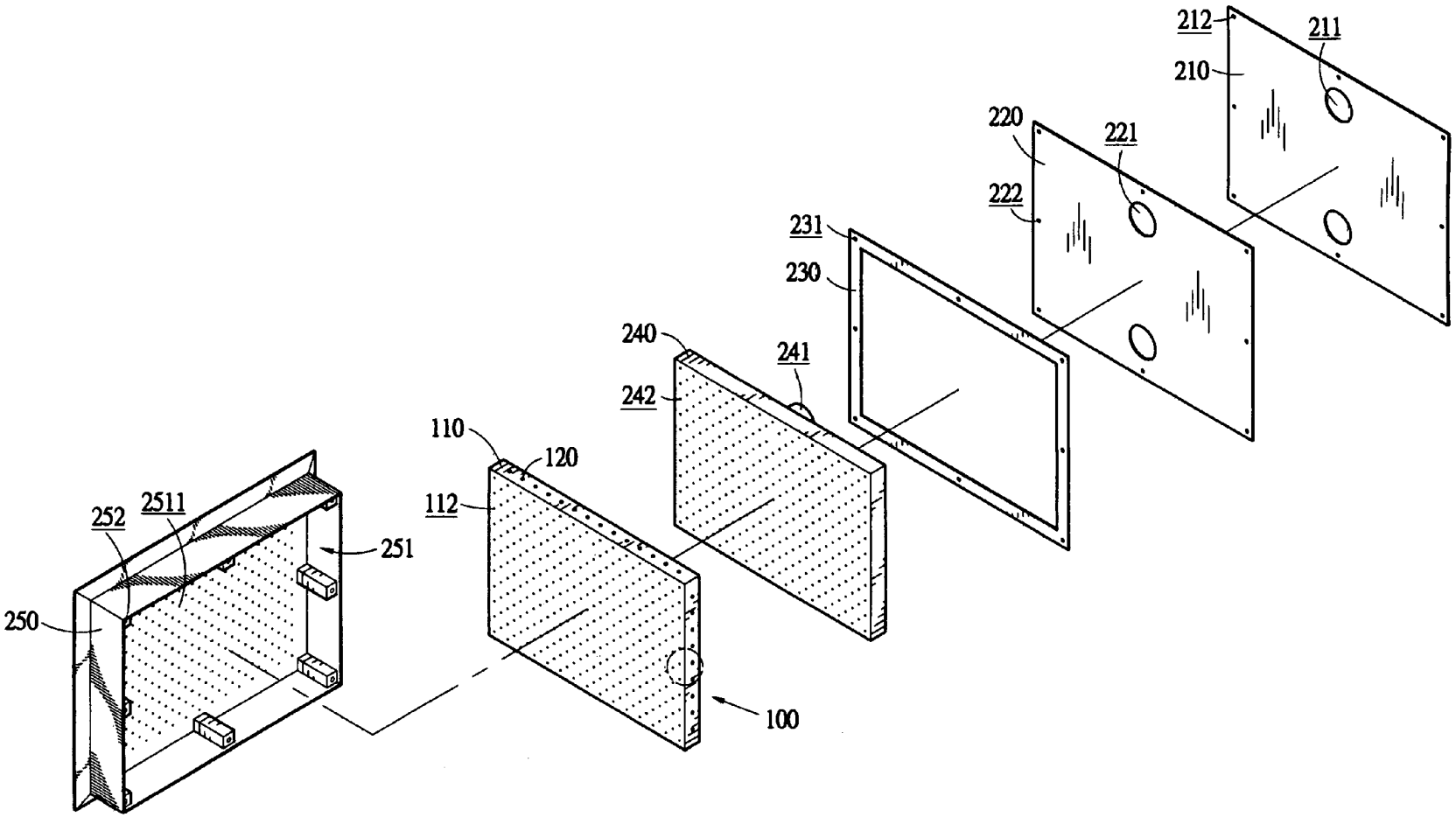
FIG. 5 is an exploded view of the water spraying device of FIG. 4.
Figure 6:
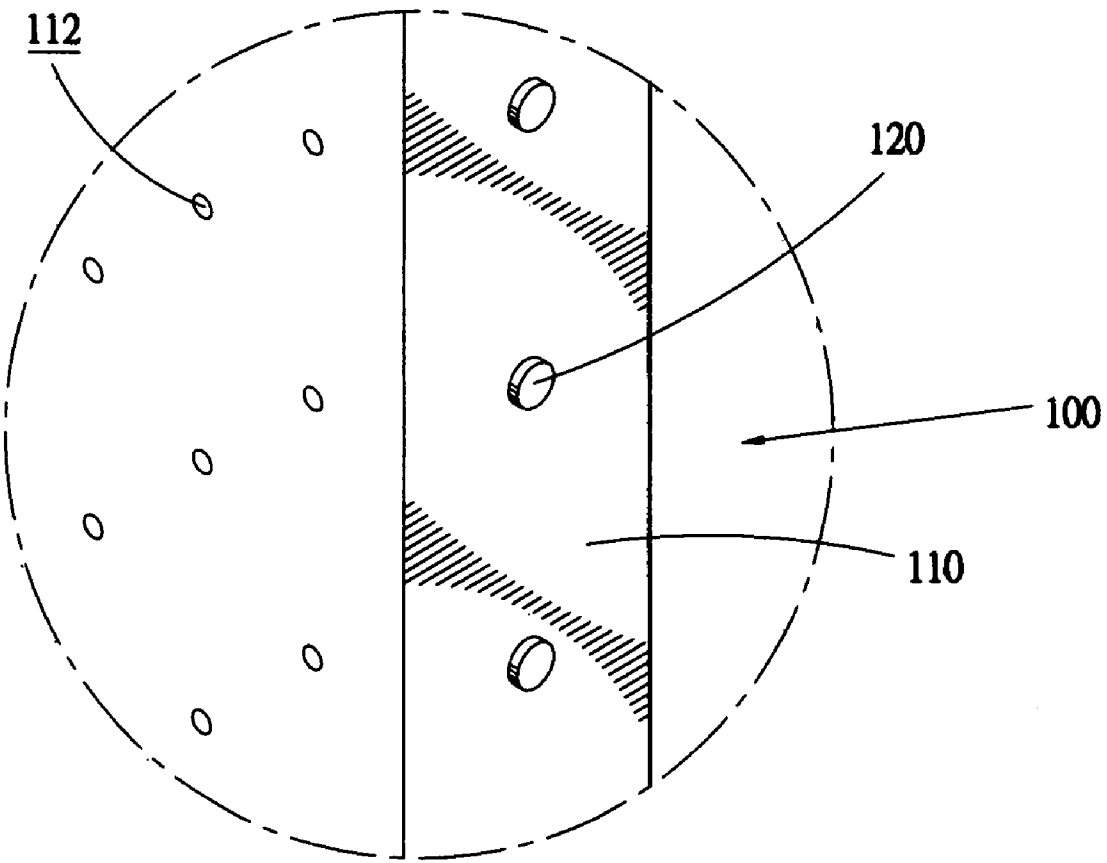
FIG. 6 is an enlarged view illustrating the light-emitting elements mounted to side edges of the light guide block of the light guide device in accordance with the present invention.

With reference to the drawings and in particular to FIGS. 1-3, a light guide device constructed in accordance with the present invention, generally designated with reference numeral 100, is provided for a water spraying device. The light guide device 100 comprises at least one light guide block 110 and a plurality of light-emitting elements 120. The light guide block 110 is made of a light-transmitting material having a refractive index greater than one, such as transparent or clear acrylic board. The light guide block 110 has opposite major surfaces connected by circumferential edge faces. In the embodiment illustrated, the light guide block 110 is a rectangular block or board having four circumferential side edges connecting between the two major surfaces. The circumferential side edges of the light guide block 110 forms a plurality of mounting holes 111. The light guide block 110 also forms a plurality of through holes 112 and each through hole 112 is delimited by a roughened inside surface. In the embodiment illustrated, the through holes 112 extend between the major surfaces and completely through the light guide block 110. The through holes 112 extend in directions that are substantially normal to or perpendicular to axes of the mounting holes 111. The light-emitting elements 120 can be of any known type, and light-emitting diodes are considered a preferred example of the light-emitting elements 120 in the embodiment illustrated. The light-emitting elements 120 can be powered in any suitable way. For example, an external power source 130, such as a DC power source, may be employed to supply electrical power to the light-emitting elements 120, as shown in FIG. 3, or alternatively, batteries or cells can be mounted inside the light guide block 110 to supply DC power to the light-emitting elements 120. The light-emitting elements 120, powered by either the external power source 130 or the inside-arranged cells, emits a light ray A, which transmits through inside the light guide block 110 and is subject to reflection caused by the major surfaces of the light guide block 110 to eventually reach and pass through the roughened surface of the through holes 112 to enter the through hole 112.

Also referring to FIGS. 4-7, an application of the light guide device 100 of the present invention is illustrated, in which the light guide device 100 is embedded in a water spraying device, generally designated at 200. The water spraying device 200 can be of any known type, such as a water jet nozzle of a fountain or a sprayer for cleaning human body or articles, for example a shower head. The water spray device 200 comprises a lid 210, a water-resistant pad 220, a metal backing plate 230, at least one water container 240, a housing 250. The lid 210 forms at least one water supply hole 211, which is coupled to a water supply source. A plurality of fastening holes 212 is defined in portions along edges of the lid 210.

The water-resistant pad 220 is a rubber pad that is waterproof and water resistant. The water-resistant pad 220 is attached to an inside surface of the lid 210 to provide a water-resistant sealing. The water-resistant pad 220 defines holes 221 corresponding in position to the water supply holes 211 of the lid 210. A plurality of through holes 222 is defined in portions along edges of the water-resistant pad 220 and corresponds in position to the plurality of fastening holes 212 of the lid 210.

The backing plate 230 is attached to the water-resistant pad 220 and opposite to the lid 210 for structure reinforcing purposes. The backing plate 230 forms a plurality of holes 231, which are distributed along edges of the backing plate 230 and correspond in locations to the through holes 222 of the water-resistant pad 220.

Figure 7:
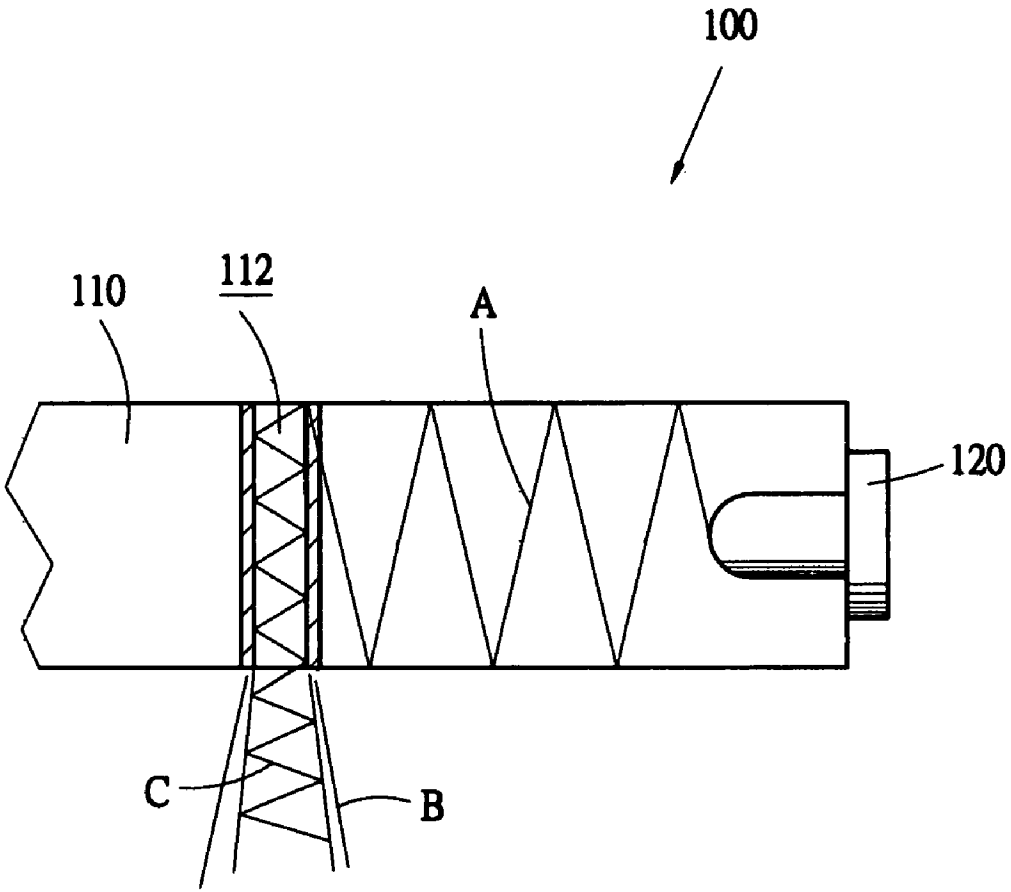
FIG. 7 is a schematic view illustrating light rays traveling out of the through hole of the light guide block with a water jet that also moves through the through hole to provide lighting or luminous effect to the water jet.

The water container 240 is attached to the backing plate 230 and is opposite to the water-resistant pad 220. The water container 240 comprises at least one water conduit 241 that is coupled to each water supply hole 211 of the lid 210 to convey water from the water supply hole 211 to an interior space of the water container 240. The water container 240 has a surface, which will also be referred to as water discharge surface, opposite to and distant from the backing plate 230 and a plurality of water discharge holes 242 is defined in the surface to discharge water jets B, as shown in FIG. 7.

The through holes 112 of the light guide device 100 are arranged by the water discharge surface of the water container 240 and correspond in position to the water discharge holes 242 of the water container 240, whereby the water jets B discharged through the water discharge holes 242 of the water container 240 are allowed to move into and travel through the through holes 112 of the light guide device 100. The light-emitting elements 120 of the light guide device 100 give off light rays A that transmit through, as being reflected by the major surfaces of the light guide block 110, to transmit through the roughened surface of the through holes 112 and get into the through holes 112. The light ray A is then subject to reflection induced in the water jet B traveling through the through hole 112 and eventually leaving the through hole 112 as ray C with the water jet B, as shown in FIG. 7. The water jet B has substantially smooth circumferential outline surface, which makes the water jet B functioning like an optic fiber, so that the ray C is subject to repeated reflection by the outline surface of the water jet B so as to travel substantially along the water jet B and thus making the water jet B uniformly lit and giving off consistent coloring with the light ray C from the light-emitting element 120.

The housing 250 forms an accommodation chamber 251 in which the water container 240 and the light guide device 100 of the present invention are received and retained. The housing 250 has a closed surface or bottom in which a plurality of water jetting holes 2511 is defined. The water jetting holes 2511 are set at locations corresponding to the through holes 112 of the light guide block 110 of the light guide device 100 whereby the water jets B, as well as the ray C traveling along each water jet B, may get through the water jetting holes 2511 for spraying or jetting. The housing 250 is provided with internally-threaded holes 252 corresponding to the holes 231 of the metal backing plate 230 and engageable with screws or bolts 253 that are fit into and through the fastening holes 212 of the lid 210, the through holes 222 of the water-resistant pad 220, and the holes 231 of the metal backing plate 230 to secure the lid 210, the water-resistant pad 220, and the metal backing plate 230 to the housing 250 with the water container 240 and the light guide device 100 securely received and retained in the housing 250.

Although the lid 210, the water-resistant pad 220, the backing plate 230, the water container 240, the light guide devices 100, and the housing 250 are fixed together by threading fasteners 253 in the previous discussion, it is apparent that these parts/components can be fixed together by any other known and suitable means, such as adhesives.

Figure 8:
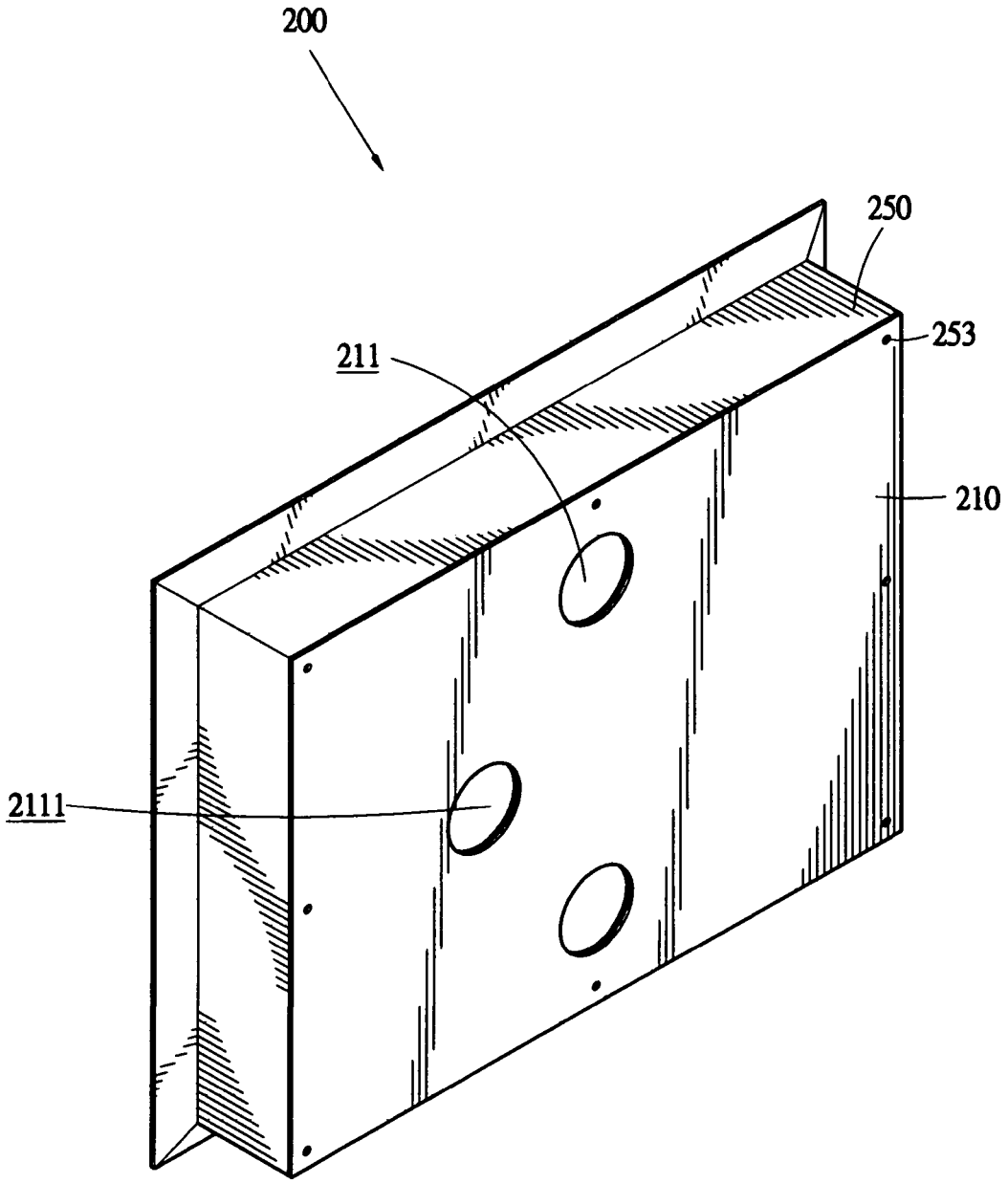
FIG. 8 is a perspective view showing a water spraying device in which a light guide device in accordance with a second embodiment of the present invention is incorporated.
Figure 9:
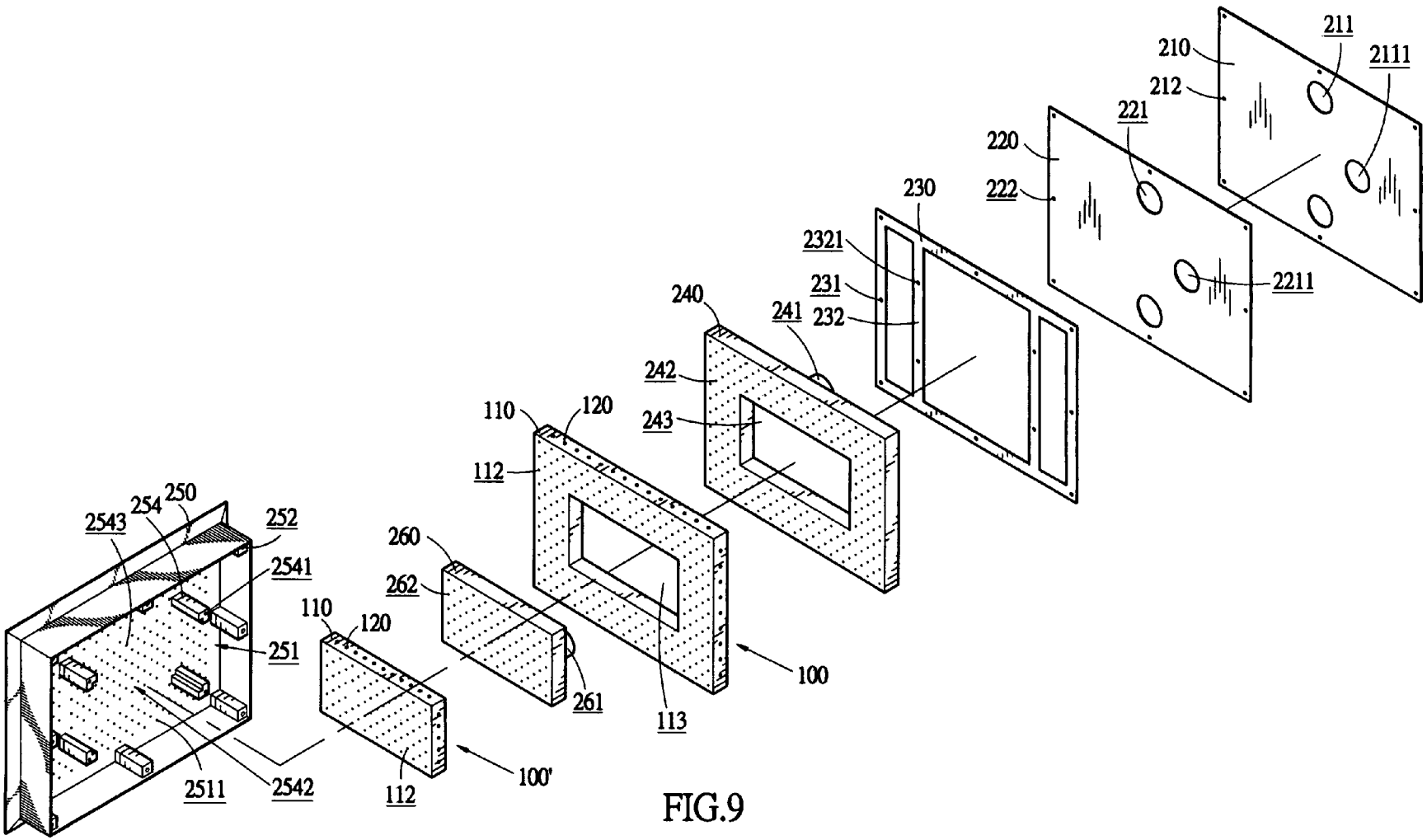
FIG. 9 is an exploded view of the water spraying device of FIG. 8.
Figure 10:
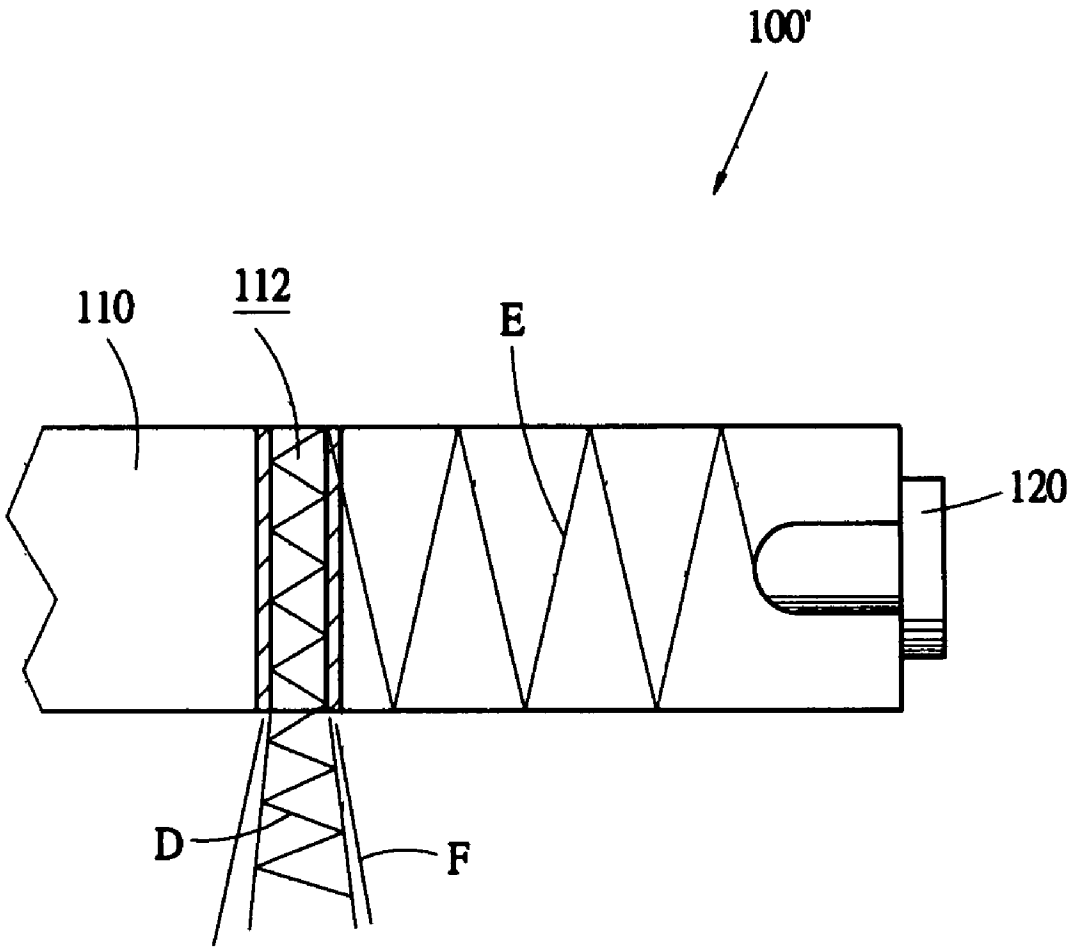
FIG. 10 is a schematic view illustrating light rays traveling out of a through hole of a light guide block of the second embodiment with a water jet that also moves through the through hole to provide lighting or luminous effect to the water jet.

Referring now to FIGS. 8-10, an application of light guide device in accordance with another embodiment (second embodiment) to a water spraying device is illustrated. In the second embodiment of the present invention, the light guide device consists of a primary light guide device 100 and a secondary light guide device 100', which are used in combination to provide lighting decoration to water jets sprayed from the water spraying device 200. It is noted that to simplify the description, similar parts of the second embodiment carry the same reference numeral as the counterpart of the previous embodiment. As shown, in addition to the water supply hole(s) 211, the lid 210 is further provided with a secondary water supply hole 2111 that is also coupled to the water supply source. Secondary fastening holes 213 are further defined in the lid 210. The water-resistant pad 220, besides the holes 221, also forms a secondary hole 2211 that correspond in position to the secondary water supply hole 2111 of the lid 21. The water-resistant pad 220 further defines secondary through holes 223, in addition to the through holes 222. The secondary through holes 223 correspond in position to the secondary fastening holes 213 of the lid 210. The metal backing plate 230 comprises two internal bars 232 in which secondary holes 2321 are defined, corresponding in position to the secondary through holes 223 of the water-resistant pad 220.

In the second embodiment, the water container 240 is constructed as a frame-like structure, which forms an internal hollow cavity 243 in which a secondary water container 260 is received and accommodated. The secondary water container 260 has a secondary water conduit 261 coupled to the secondary water supply holes 2111 of the lid 210 to convey water from the water supply source to an interior space of the secondary water container 260. The secondary water container 260 has a surface, which will also be referred to as secondary water discharge surface, opposite to and distant from the lid 210 and in preferably coplanar with the water discharge surface of the water container 240, and a plurality of secondary water discharge holes 262 is defined in the secondary water discharge surface to discharge water jets D, as shown in FIG. 10.

In the second embodiment, the light guide device (the primary light guide device) 100 is made a frame-like structure having an internal hollow cavity 113 corresponding in size, shape and position to the internal cavity 243 of the water container 240. The secondary light guide device 100' is arranged in the hollow cavity 113 and, similar to the primary light guide device 100, contains light-emitting elements 120 that give off light rays E. The ray E transmits through a light guide block 110 of the secondary light guide device 100' as being repeatedly reflected by major surfaces of the light guide block 110 of the secondary light guide device 100' to reach and pass through roughened surface of each through holes 112 defined in the light guide block 110. The ray E enters the through holes 112 and transmit into a water jet D that is discharged through each secondary water discharge hole 262 of the secondary water container 260 and moves through the through holes 112 of the secondary light guide device 100' to eventually travel with the water jet D out of the through hole as ray F, as shown in FIG. 10. Since the water jet D has substantially smooth circumferential outline surface, which makes the water jet D functioning like an optic fiber, so that the ray F is subject to repeated reflection by the outline surface of the water jet D so as to travel substantially along the water jet D and thus making the water jet D uniformly lit and giving off consistent coloring with the light ray F from the light-emitting elements 120.

The housing 250 is further provided with internal posts 254 each defining an internally-threaded hole 2541. Preferably and as illustrated in the drawings, the posts 254 are arranged to define a space or a secondary chamber 2542 sufficient to accommodate the secondary light guide device 100' and the secondary water container 260. In addition to the water jetting holes 2511 defined in the bottom of the housing 250, the housing 250 also forms a plurality of secondary water jetting holes 2543 in a portion of the bottom thereof that corresponds to the space 2542. Accordingly, the accommodation chamber 251 that is provided for the primary light guide 100 is arranged around the space of the secondary chamber 2542. Thus, the through holes 112 of the light guide block 110 of the secondary light guide device 100' are set corresponding to the secondary water jetting holes 2543, whereby the water jets D from the secondary water container 260, with the rays F traveling therewith, are allowed to sprayed out of the housing 250 through the secondary water jetting holes 2543. The housing 250 has an interior space that is a combination of the accommodation chamber 251 and the secondary chamber 2542, wherein the water container 240 and the primary light guide device 100 are received and retained in the accommodation chamber 251 with the hollow cavities 243, 113 thereof located in the secondary accommodation chamber 251, and outboard the posts 254 to respectively receive the secondary water container 260 and the secondary light guide device 100'. Thus, the water jets B, together with the rays C traveling therewith, are sprayed out of the housing 250 through the water jetting holes 2511 located in an area of the bottom of the housing corresponding to the accommodation chamber 251. Consequently, the water jets B (with the rays C) and the water jets D (with the rays F) are sprayed out of the housing 250 through a circumferential marginal area and a central area of the bottom of the housing 250 whereby by proper selection and combination of the water jets B and D, enhanced lighting and/or coloring can be realized.

Although in the second embodiment discussed above, as shown in FIGS. 8-10, the arrangement among the primary light guide device 100 and the secondary light guide device 100' and also the water container 240 and the secondary water container, and the housing 250 are put in a nested form, it is apparent that these components/parts/devices can be arranged in different ways. For example, the interior space of the housing 250 can be divided into two juxtaposing chambers in which two water containers and two light guide devices are accommodated in a paired manner so that two types of water jets, which may carry rays of different colors, are respectively sprayed through left and right portions of the bottom of the housing 250.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A light guide device adapted to operate with a water spraying device, the light guide device comprising:

at least one light guide block made of a light-transmitting material, the light guide block defining a plurality of through holes extending therethrough, each through hole having a roughened inside surface and adapted to receive a water jet discharged by the water spraying device; and a plurality of light-emitting elements mounted to a circumferential face of the light guide block for each emitting a light ray transmitting through the light guide block and passing through the roughened surface of each through hole to get into the through hole, the light ray being subject to reflection inside the water jet so as to uniformly light the water jet and provide a color of the light ray to the water jet.

2. The light guide device as claimed in claim 1, wherein the material that makes the light guide block has a refractive index greater than one.

3. The light guide device as claimed in claim 1, wherein the material that makes the light guide block comprises clear acrylic material.

4. The light guide device as claimed in claim 1, wherein the light guide block forms a plurality of mounting holes in the circumferential face thereof for mounting the light-emitting elements.

5. The light guide device as claimed in claim 1, wherein the light-emitting elements comprise light-emitting diodes.

* * * * *